US008690027B2

(12) United States Patent
Berger et al.

(10) Patent No.: US 8,690,027 B2
(45) Date of Patent: Apr. 8, 2014

(54) ICE DISPENSER DUCT DOOR MOTOR WITH ADJUSTABLE DRIVE

(75) Inventors: Justin Daniel Berger, Louisville, KY (US); Andrew Reinhard Krause, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 28 days.

(21) Appl. No.: 13/523,004

(22) Filed: Jun. 14, 2012

(65) Prior Publication Data

US 2013/0334261 A1 Dec. 19, 2013

(51) Int. Cl.
*F25C 5/00* (2006.01)
*H02P 7/00* (2006.01)

(52) U.S. Cl.
USPC ..... 222/504; 222/146.6; 318/466; 318/430

(58) Field of Classification Search
USPC ..... 222/333, 146.6, 504; 62/340, 344, 389; 318/11, 266, 466, 430, 264–265, 272, 318/275, 277, 282, 286, 467–469, 626
See application file for complete search history.

(56) References Cited

U.S. PATENT DOCUMENTS

| | | | | |
|---|---|---|---|---|
| 3,640,089 | A * | 2/1972 | Frazier | 62/320 |
| 3,942,334 | A * | 3/1976 | Pink | 62/266 |
| 4,139,126 | A * | 2/1979 | Krasner et al. | 222/146.6 |
| 4,701,684 | A * | 10/1987 | Seidel et al. | 318/282 |
| 4,739,233 | A * | 4/1988 | Marcade | 318/474 |
| 4,942,979 | A * | 7/1990 | Linstromberg et al. | 221/75 |
| 5,474,213 | A * | 12/1995 | Unger | 222/108 |
| 7,208,897 | B2 * | 4/2007 | Hotto et al. | 318/466 |
| 7,267,198 | B2 * | 9/2007 | Cen | 184/105.2 |
| 7,703,297 | B2 | 4/2010 | Bowen et al. | |
| 8,094,357 | B2 * | 1/2012 | Mizukami et al. | 359/224.1 |
| 8,348,108 | B2 * | 1/2013 | Choi | 222/504 |
| 2006/0168984 | A1 | 8/2006 | Myers | |
| 2007/0119204 | A1 * | 5/2007 | Kwon | 62/340 |
| 2007/0256442 | A1 | 11/2007 | Lyvers et al. | |

(Continued)

FOREIGN PATENT DOCUMENTS

WO WO 2009/017285 2/2009

OTHER PUBLICATIONS

Baldor Electric Company, Dec. 8, 1998, Servo Control Facts: A Handbook Explaining the Basics of Motion, Baldor Motors and Drives, p. 13.*

*Primary Examiner* — Paul R Durand
*Assistant Examiner* — Charles P Cheyney
(74) *Attorney, Agent, or Firm* — Dority & Manning, P.A.

(57) ABSTRACT

An ice dispensing assembly in an appliance and a method of controlling a duct door in an ice dispensing assembly is provided. A duct door is actuated to dispense ice using a motor. The motor can be variably driven using an electrical signal having a plurality of different levels or slopes during the actuation of the duct door. The electrical signal can have an increasing slope when the duct door is actuated into an open position. When the duct door is held in the open position, a constant electrical signal can be applied to the motor. The constant value can be lower than a peak value of the increasing slope of the electrical signal. To return the duct door to a closed position, an electrical signal having a decreasing slope can be applied to the duct door motor.

20 Claims, 10 Drawing Sheets

(56) References Cited

U.S. PATENT DOCUMENTS

| | | | | |
|---|---|---|---|---|
| 2008/0156027 | A1 | 7/2008 | Jeong et al. | |
| 2008/0257672 | A1* | 10/2008 | Smith et al. | 188/4 R |
| 2009/0165492 | A1* | 7/2009 | Wilson et al. | 62/344 |
| 2009/0308887 | A1* | 12/2009 | Woo et al. | 222/52 |
| 2010/0089492 | A1* | 4/2010 | Dirnberger et al. | 141/351 |
| 2010/0122547 | A1* | 5/2010 | Han et al. | 62/340 |
| 2010/0132835 | A1 | 6/2010 | Oh | |
| 2012/0017512 | A1 | 1/2012 | Lee et al. | |

* cited by examiner

ICE DISPENSER DUCT DOOR MOTOR WITH ADJUSTABLE DRIVE

FIELD OF THE INVENTION

The present disclosure relates to an ice dispenser and more particularly to an improved method of actuating a duct door of an ice dispenser.

BACKGROUND OF THE INVENTION

An appliance such as a refrigerator can include an icemaker to provide ice cubes to a user. The ice cubes can be produced automatically or without any interaction with a user. Generally, the icemaker is disposed in a compartment inside the refrigerator and often ice cubes can be can be dispensed through an opening in the door.

A duct door can be coupled to the opening such that it separates the ice making and storage assembly from the outside of the appliance. A mechanism is needed to actuate the duct door from a closed position to an open position. When the duct door is in the open position, ice cubes can pass through a chute to the outside of the appliance.

Conventionally, the mechanism to actuate the duct door includes a solenoid. A solenoid is a linear actuator comprised of an electromagnet and biased piston that is connected to a crank and when the solenoid is energized the piston moves to turn the crank and move the duct door. The use of a solenoid can create undesirable noise during ice dispensing. In addition, solenoids consume a significant amount of power.

In another conventional approach, a DC stepper motor or AC motor can be used as the mechanism to actuate the duct door. Due to inherent design properties of a stepper motor, a significant amount of vibration is created during actuation of the motor. The vibration creates undesirable noise. When a constant-power AC motor is used to actuate a duct door, numerous elements such as cam rollers, cam followers, and/or position detection switches must be coupled to the motor. This increases the complexity of the device and the manufacturing process while also increasing the cost.

Thus, a need exists for an improved ice dispensing control system for actuating a duct door. A system and method that can reduce noise and power consumption during duct door actuation would be particularly useful.

BRIEF DESCRIPTION OF THE INVENTION

Aspects and advantages of the invention will be set forth in part in the following description, or may be apparent from the description, or may be learned through practice of the invention.

One exemplary aspect of the present disclosure is directed to an ice dispensing assembly in an appliance. The ice dispensing assembly can include an icemaker assembly configured to form ice cubes and store ice cubes, an ice cube duct configured to direct ice cubes from the icemaker assembly, a duct door coupled to the ice cube duct, the duct door configured to actuate between an open position and a closed position where ice cubes are directed from the icemaker assembly when the duct door is in the open position, a motor configured to actuate the duct door between the open position and the closed position, and a controller. The controller can be configured to adjustably drive the motor such that an electrical signal applied to the motor varies during a dispensing cycle. This variation can include an increasing slope, a constant value, and a decreasing slope.

Another exemplary aspect of the present disclosure is directed to a method of controlling an ice dispensing assembly of an appliance. The method can include driving a motor using an electrical signal having an increasing slope to actuate a duct door into an open position, where ice cubes are directed from an icemaker assembly when the duct door is in the open position; driving the motor using the electrical signal having a constant value to hold the duct door in the open position; and driving the motor using the electrical signal having a decreasing slope to actuate the duct door into a closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
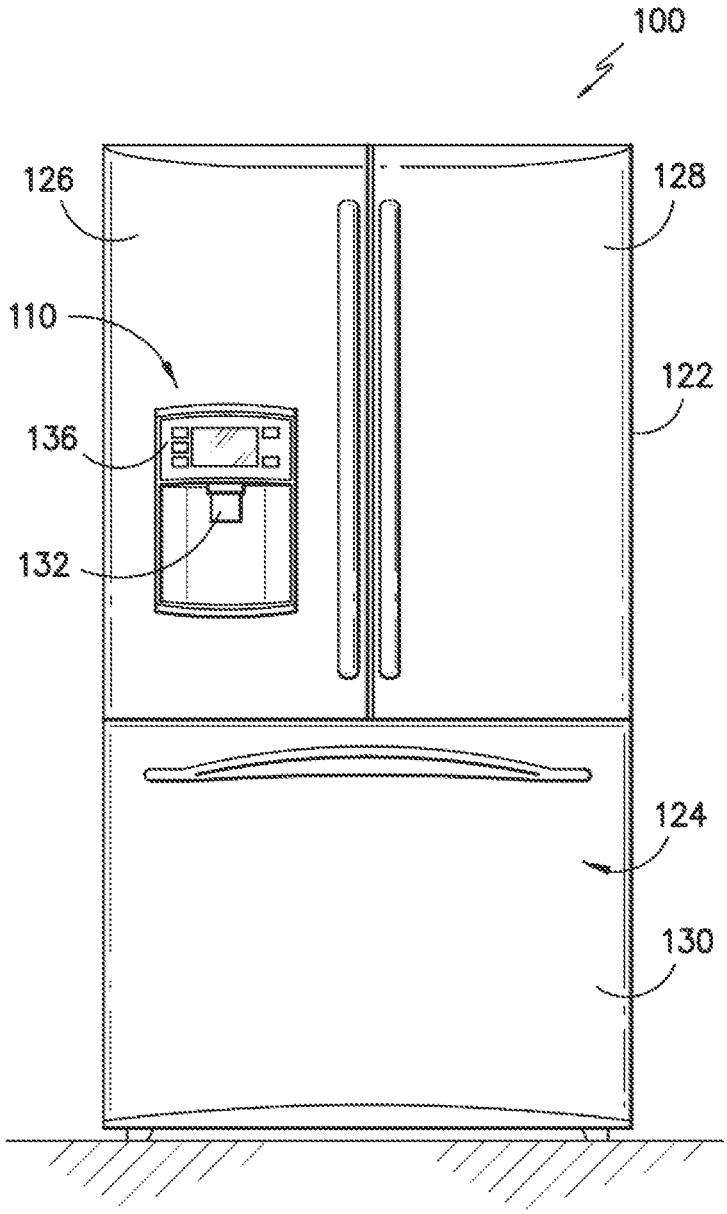
FIG. 1 depicts a front view of an exemplary refrigerator appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure relates to an ice dispensing assembly in an appliance and a method of controlling a duct door in an ice dispensing assembly. A duct door is actuated to dispense ice using a motor. The motor can be variably driven using an electrical signal having a plurality of different levels or slopes during the actuation of the duct door. The electrical signal can have an increasing slope when the duct door is actuated into an open position. When the duct door is held in the open position, a constant electrical signal can be applied to the motor. The constant value can be lower than a peak value of the increasing slope of the electrical signal. To return the duct door to a closed position, an electrical signal having a decreasing slope can be applied to the duct door motor.

According to aspects of the present disclosure, variably driving a duct door motor can increase the smoothness of the duct door movement and reduce the noise generated while ice is dispensed from an ice making assembly. Implementing a driving method that includes driving the motor using an electrical signal having an increasing slope, a constant value and a decreasing slope can reduce power requirements.

Figure 2:
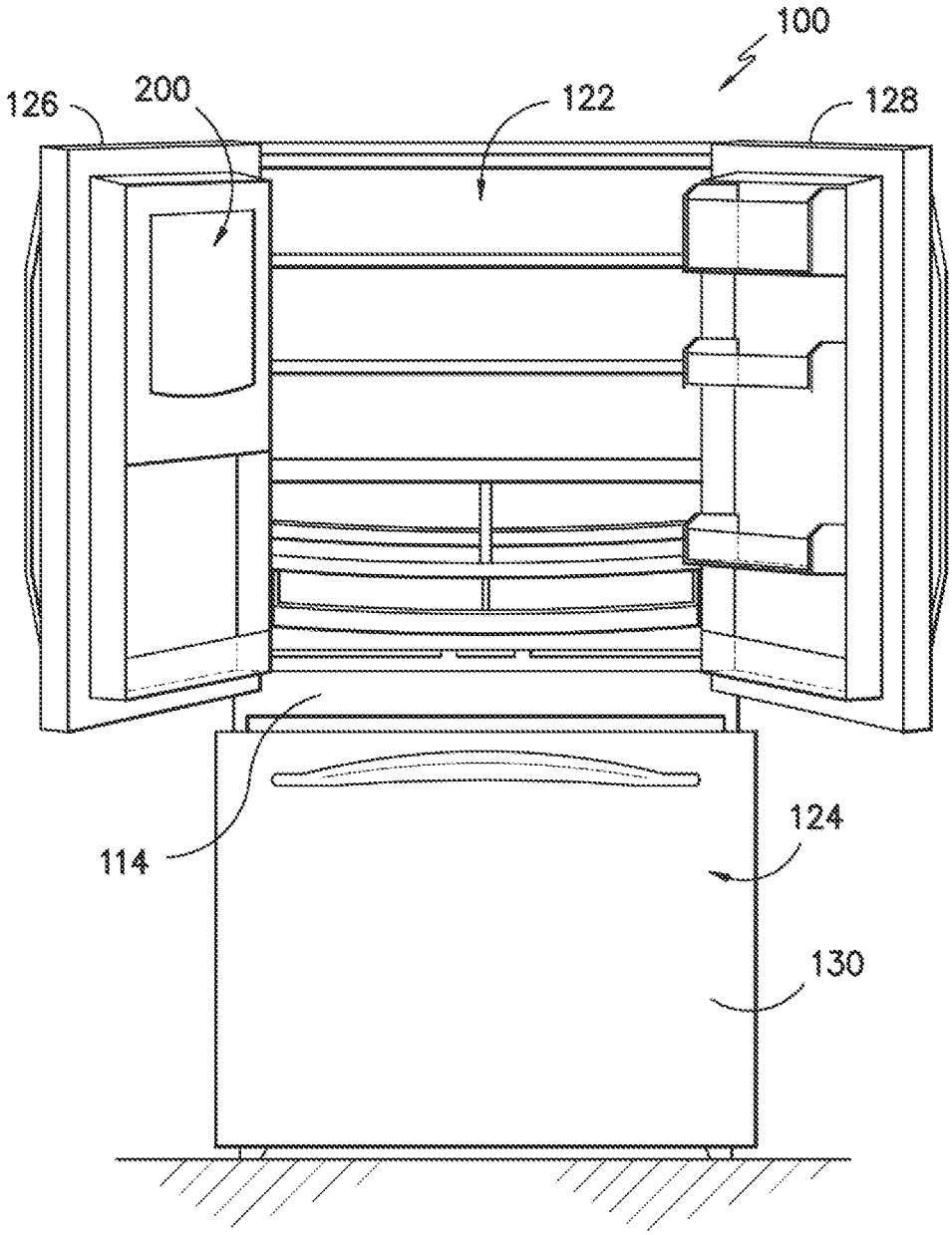
FIG. 2 depicts a front view of an interior of an exemplary refrigerator appliance according to an exemplary embodiment of the present disclosure.
Figure 3:
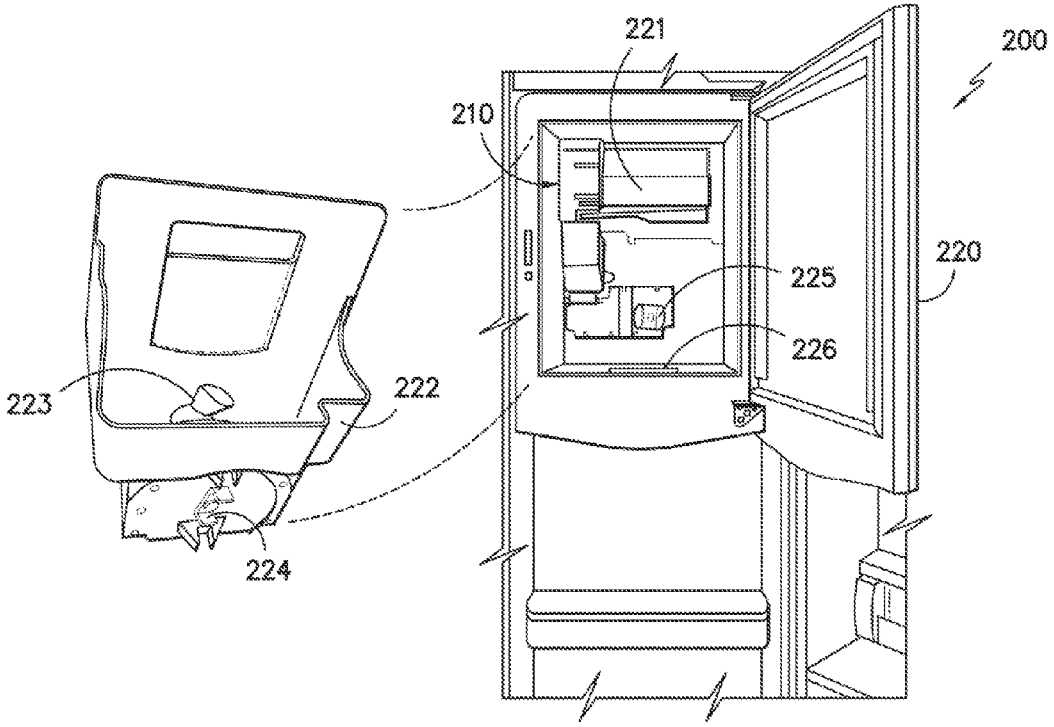
FIG. 3 depicts a front view of an exemplary icemaker assembly in a refrigerator appliance according to an exemplary embodiment of the present disclosure.

FIGS. 1-3 illustrate an exemplary refrigerator 100 according to an exemplary embodiment of the present disclosure. Specifically, FIG. 1 depicts a front view of an exemplary refrigerator 100 according to an exemplary embodiment of the present disclosure. FIG. 2 depicts an alternative front view of an exemplary refrigerator 100 according to an exemplary embodiment of the present disclosure and FIG. 3 depicts internal views of an icemaker assembly in an exemplary refrigerator 100 according to an exemplary embodiment of the present disclosure.

Refrigerator 100 can include a fresh food compartment 122, a freezer compartment 124 and an ice making and storage assembly 200. Although the refrigerator 100 is shown as a "bottom freezer" type, the arrangement of the fresh food compartment, the freezer compartment, and the icemaker assembly are not limited to this type of configuration of a refrigerator. Any appliance having an icemaker assembly, in any configuration or arrangement, is intended to be included in the present disclosure.

The fresh food compartment 122 having doors 126, 128, and the freezer compartment 124 having an access door 130 are contained within a main body and can be separated by a mullion wall 114. Access door 130 can provide drawer access to the freezer compartment 124. However, any type of door configuration can be used such as a single access door.

A dispensing assembly 110 for dispensing ice from the icemaker assembly 200 can be included in a door 126 of the refrigerator 100. The dispensing assembly 110 can be included in either door 126, 128 and can also dispense water from the refrigerator 100. A dispensing assembly control panel 136 can include input devices for a user to select various dispensing options such as ice cube size or water temperature. For instance, the dispensing assembly control panel 136 can include a display, buttons, toggles, switches, etc.

A paddle 132 can be included in the dispensing system 110. The paddle 132 can be coupled to a controller (not shown) such that when a user contacts the paddle, ice cubes or water can be dispensed to the user from the refrigerator 100. In addition, a switch may be coupled between the paddle 132 and the controller such that a signal indicative of dispensing is sent to the controller when the switch is actuated by the paddle 132.

As illustrated in FIG. 3, an ice making and storage assembly (icemaker) 200 can be mounted on a surface of the access door 126 of the fresh food compartment 122. However, the icemaker 200 can be mounted in any door or on any surface of an appliance. Alternatively, icemaker 200 can be mounted within refrigerator 100 and include an access opening to provide ice cubes through a door 126, 128 of the refrigerator 100.

The ice making and storage assembly 200 can include a thermally insulated ice compartment 210 and an access door 220 which faces the fresh food compartment 122. The thermally insulated ice compartment 210 can be mounted on or formed in the access door 126. Alternatively, the icemaker 221 can be disposed in the freezer compartment 124 and be connected to or in communication with the ice compartment 210 through a channel or duct. Ice cubes can be withdrawn from the icemaker assembly using ice dispenser assembly 110 installed in the access door 126. In addition, access door 220 can provides access to ice cubes when door is open.

An ice maker 221 and an ice storage bin 222 can be included in ice compartment 210. During normal icemaker operations, a water valve (not shown) can be actuated to allow water to flow into cavities of an ice cube mold in ice maker 221. A heater can heat the ice cube mold to release the ice cubes from the mold after the ice cubes are formed. A rake or other dislodging device (not shown) can be used to harvest or remove the ice cubes from the mold and into an ice cube storage bin 222. An ice cube separation device, such as an auger 223 can be disposed in the ice cube storage bin 222. Auger 223 can be actuated by a motor 225 disposed in the ice compartment to separate ice cubes in bin 222 to dispense ice cubes through ice dispensing channel or duct 226. Motor 225 can be coupled with auger actuation device 224 to actuate the auger 223.

Figure 4:
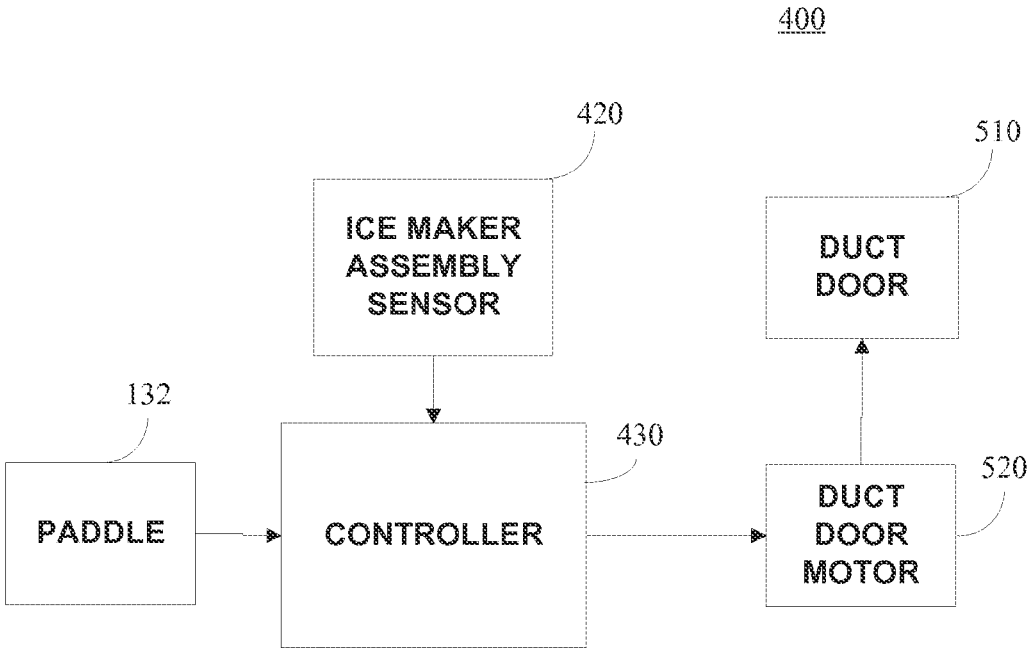
FIG. 4 depicts a block diagram of an exemplary duct door control assembly according to an exemplary embodiment of the present disclosure.

FIG. 4 depicts a block diagram of an exemplary duct door control assembly 400 according to an exemplary embodiment of the present disclosure. Duct door control assembly 400 can include a paddle 132, an ice maker assembly sensor 420, a controller 430, a duct door motor 520, and a duct door 510.

Figure 5:
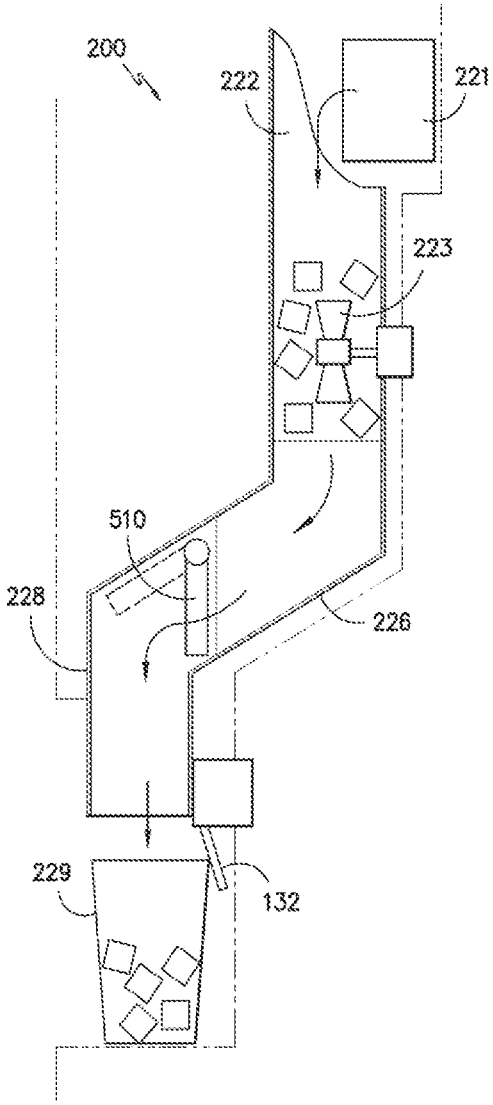
FIG. 5 depicts a cross-sectional view of an exemplary icemaker assembly in a refrigerator appliance according to an exemplary embodiment of the present disclosure.

As illustrated in FIG. 5, when a drinking vessel 229, or any other type of ice cube receiving device, contacts the paddle 132, a signal indicative of ice cube dispensing initiation is sent to the controller 430. A paddle 132 is provided as an example of an ice cube dispensing request device however, any device can be used such that a user interacts with the device to initiate ice cube dispensing.

Controller 430 can control the duct door assembly 400 such that ice cube dispensing can occur from the ice bin. Controller 430 can be the same controller used by the appliance for all operations or it can be a separate controller. If it is a separate controller, it could be solely for icemaker control or it could also control other sub-appliance controls. The controller 430 can be located within the ice compartment assembly 200 or at any other location within the refrigerator appliance 100.

By way of example, any/all of the "controllers" discussed in this disclosure can include a memory and one or more processing devices such as microprocessors, CPUs or the like, such as general or special purpose microprocessors operable to execute programming instructions or micro-control code associated with operation of an icemaker assembly in an appliance. The memory can represent random access memory such as DRAM, or read only memory such as ROM or FLASH. In one embodiment, the processor executes programming instructions stored in memory. The memory can be a separate component from the processor or can be included onboard within the processor. Alternatively, the controller might also be constructed without using a microprocessor, using a combination of discrete analog and/or digital logic circuitry (such as switches, amplifiers, integrators, comparators, flip-flops, AND gates, and the like) to perform control functionality instead of relying upon software.

According to particular aspects of the present disclosure, the controller 430 can receive a signal indicative of an ice cube dispensing initiation. When the paddle 132 is in contact with an ice cube receiving device, the controller can provide an electrical signal to the duct door motor 520 to actuate the duct door into an open position. The electrical signal that actuates the duct door into the open position can be a voltage having an increasing slope which gradually increases torque to ease the duct door into the open position. By applying an electrical signal having an increasing slope, the noise associated with actuating the duct door can be reduced with no dampers or cams protecting from impact. After the duct door reaches the open position, the electrical signal is adjusted to a constant value to conserve power consumption during ice cube dispensing. The constant value can be less than a peak value of the electrical signal having an increasing slope. Ice cubes can be dispensed into the drinking vessel 229 through a chute 228 when the duct door 510 is held in an open position.

After ice cube dispensing is complete and the drinking vessel 229 is removed from contact with the paddle 132, the controller 430 can supply an electrical signal to the duct door motor 520 to actuate the duct door 510 into a closed position. The electrical signal can be a voltage having a decreasing slope. For instance, the electrical signal can be a negative voltage used to drive the duct door motor 520 in a reverse direction. Lower voltages can be achieved using pulse width modulation at a frequency that is high enough to avoid vibration within the duct door assembly 400. In addition, the electrical signal can be pulsed to the motor prior to the duct door 510 closing. Supplying a varying electrical signal to the duct door motor 520 allows the duct door 510 to actuate positions smoothly and quietly while minimizing power consumption and utilizing the full range of torque provided by the motor.

Duct door control assembly 400 can further include an ice maker assembly sensor 420. The ice maker assembly sensor 420 can be disposed in the ice compartment to detect a temperature of the ice compartment. If the duct door 510 remains in an open position after a drinking vessel is no longer in contact with the paddle, the temperature inside the ice compartment can increase, causing ice cube deformation in the ice compartment. When the icemaker assembly sensor 420 sends a signal to the controller 430 indicative of a temperature above a predetermined threshold temperature or temperature range, the controller 430 can control the duct door motor 520 to actuate the duct door 510 into the closed position. An alert can be initiated when a temperature above the predetermined threshold is detected. The alert can be an audio and/or visual alert. This increases the robustness of the system against prolonged dispenses or debris (ice cubes or shavings) preventing the door from closing.

Figure 6:
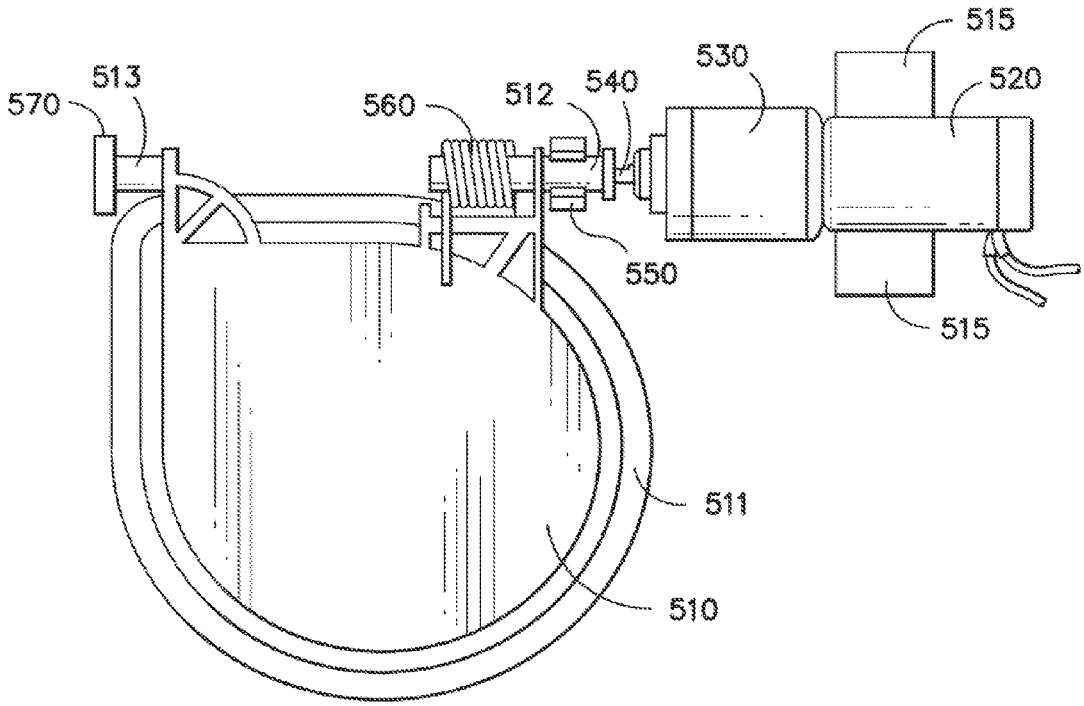
FIG. 6 depicts an exemplary duct door assembly according to an exemplary embodiment of the present disclosure.

FIG. 6 depicts a duct door assembly of an icemaker assembly according to an exemplary embodiment of the present disclosure. Duct door assembly can include duct door 510, a motor mount 515, the duct door motor 520, a planetary gearbox 530, and a spring 560.

The duct door 510 can be formed as an integral piece and can include insulation that can provide a thermal barrier between the ice compartment and ambient temperatures surrounding the refrigerator 100. Duct door 510 can have a body and a gasket 511 at least partially surrounding the duct door body. The gasket 511 can seal an opening of the ice cube dispensing duct 226 closest to the door 126 to prevent ambient air from flowing into the ice chamber causing ice cube deformation.

A planetary gearbox 530 can be coupled to the duct door motor 520. The planetary gearbox 530 can utilize gear ratio to increase the driving torque of the duct door motor 520 as well as reduce the rotational speed of the motor to prevent undesired noise. A shaft 540 of the planetary gearbox 530 can be coupled with a first projection 512 of the duct door 510.

A spring 560 can be positioned on the first projection 512 of the duct door 510 to provide a biasing force to the duct door 510. When the duct door is actuated into the open position, the torque of the duct door motor opposes the biasing force of the spring 560 to steadily move the duct door into the open position. By opposing the biasing force of the spring 560 when the duct door is actuated into the open position, noise generated by the duct door assembly can be reduced. When the duct door is actuated into the closed position, the biasing force of the spring 560 can act on the duct door to maintain a closed position. This prevents unwanted ambient air from flowing into the ice chamber melting ice cubes. The spring 560 can be positioned on either side of the duct door.

The first projection 512 of duct door 510 can be clipped into a c-shaped mounting bracket 550 such that the bracket 550 can be formed before the duct door 510 is installed and the bracket 550 allows the duct door 510 to rotate in and out of contact with the ice cube dispensing duct 226. A second projection 513 can be inserted in a hole in a duct door mounting housing 570. The duct door 510 can be installed in the mounting housing 570 before contacting the bracket 550.

Figure 7:
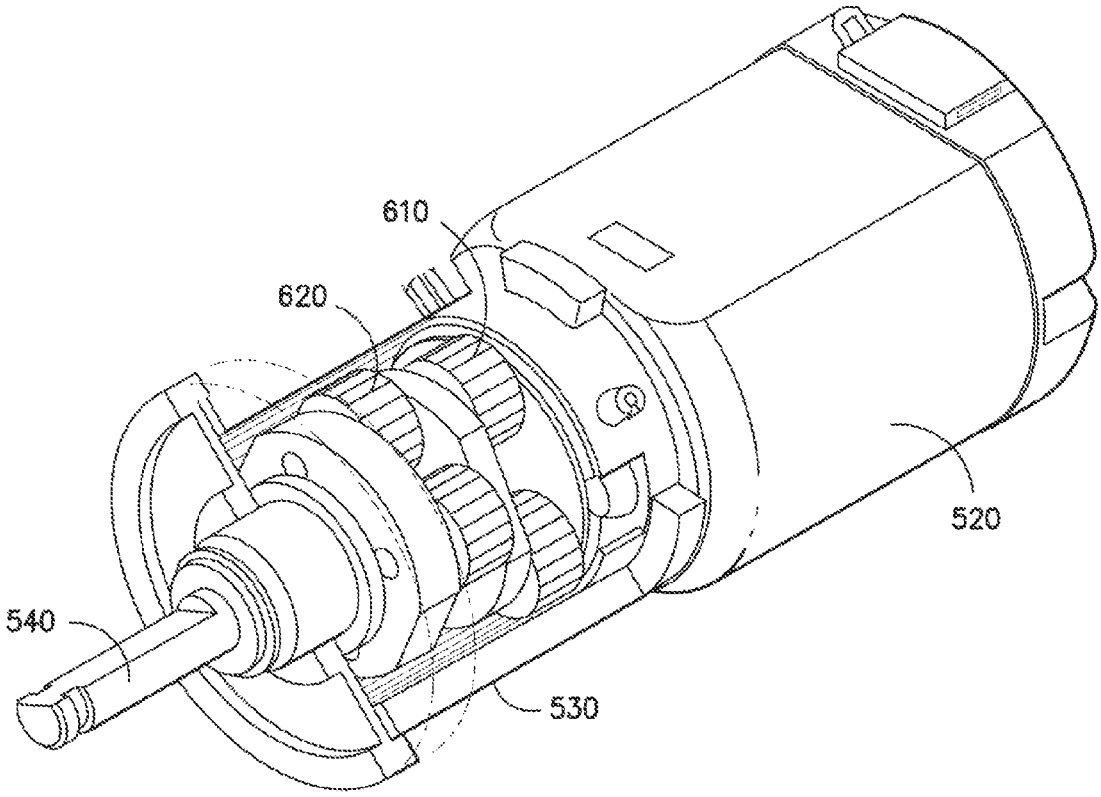
FIG. 7 depicts an exemplary motor configured to actuate a duct door assembly according to an exemplary embodiment of the present disclosure.

FIG. 7 illustrates an exemplary motor assembly 600 according to an exemplary embodiment of the present invention. Motor 520 can be a small geared, variable speed DC motor, which has speed and torque relative to the incoming DC voltage. The duct door motor 520 can be coupled to a planetary gearbox 530 having a rotatable shaft 540 to increase torque of the motor 520. Gear ratios within the planetary gear box 530 can be utilized to increase the driving torque and reduce the rotational speed of the duct door motor. The planetary gearbox 530 can include a first plurality of gears 610 having a first ratio and a second plurality of gears 620 having a second ratio. Planetary gearbox 530 can have any number of gears and ratios to achieve a desired variable motor speed.

Figure 8:
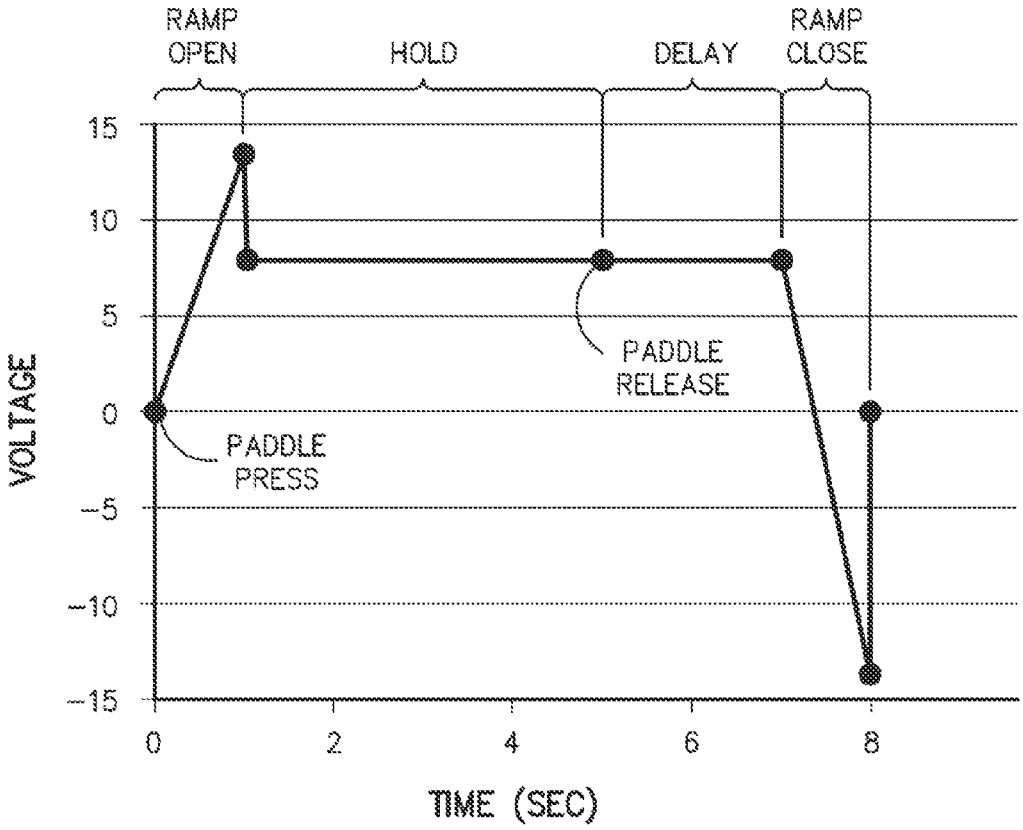
FIG. 8 depicts a graphical depiction of an exemplary power supply control according to an exemplary embodiment of the present disclosure.

FIG. 8 illustrates an exemplary power supply graph 800 of an exemplary power supply signal provided to duct door motor 520 according to an exemplary embodiment of the present disclosure. Voltage and time values included in graph 800 are merely examples and any voltage and/or time value can be used during actuation of the motor.

After the paddle is pressed, an electrical signal having an increasing slope can be applied to the duct door motor to actuate the duct door to an open position. The torque output of the duct door motor can be related to the electrical signal applied to the motor. For instance, a voltage applied to the motor can be ramped up from 0 to 13.6 volts over a one second time interval. The torque output of the motor can increase from 0 to 4 in-lbs.

When the duct door reaches the full open position, the electrical signal applied to the motor is reduced to a constant value that is less than a peak value of the electrical signal having an increasing slope. The constant value can be applied to hold the duct door open during ice cube dispensing. For instance, the voltage level can be decreased to a holding level sufficient to maintain enough torque to hold the door in the open position.

After the paddle is released, the signal having a constant value can be continuously applied for a delayed time interval to allow any dispensing cubes to clear the chute. After the predetermined delay time interval has elapse, an electrical signal can be applied to the motor that has a decreasing slope to return the duct door to a closed position. The electrical signal can be ramped such that the duct door slowly actuates into the closed position. A full closed position can be achieved by applying a greater closing torque in the reverse driving direct than the torque used to achieve the open position in the forward driving direction.

Figure 9:
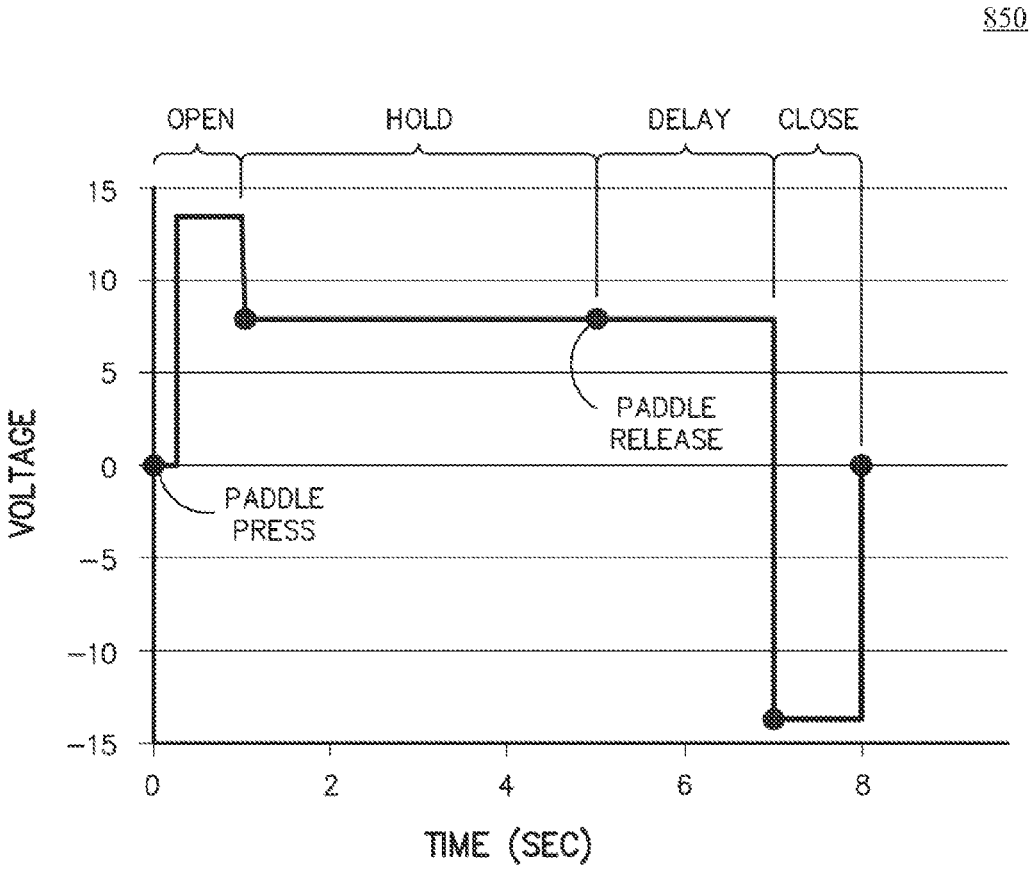
FIG. 9 depicts a graphical depiction of an exemplary power supply control according to an exemplary embodiment of the present disclosure.

FIG. 9 illustrates an exemplary power supply graph 850 of an alternative exemplary power supply signal provided to duct door motor 520 according to an exemplary embodiment of the present invention. As illustrated in FIG. 9, the power supply can have discrete voltage values.

As the paddle is pressed, an electrical signal having a first value can be applied to the duct door motor to actuate the duct door to an open position. When the duct door reaches the full open position, a signal having second value less than the first value can be constantly applied to hold the duct door in the open position during ice cube dispensing. When the paddle is released, the second value can be maintained for a predetermined time interval. After the predetermined time interval elapses, a signal having a third value less than the first and second values can be applied to the duct door motor to return the duct door to the closed position.

Figure 10:
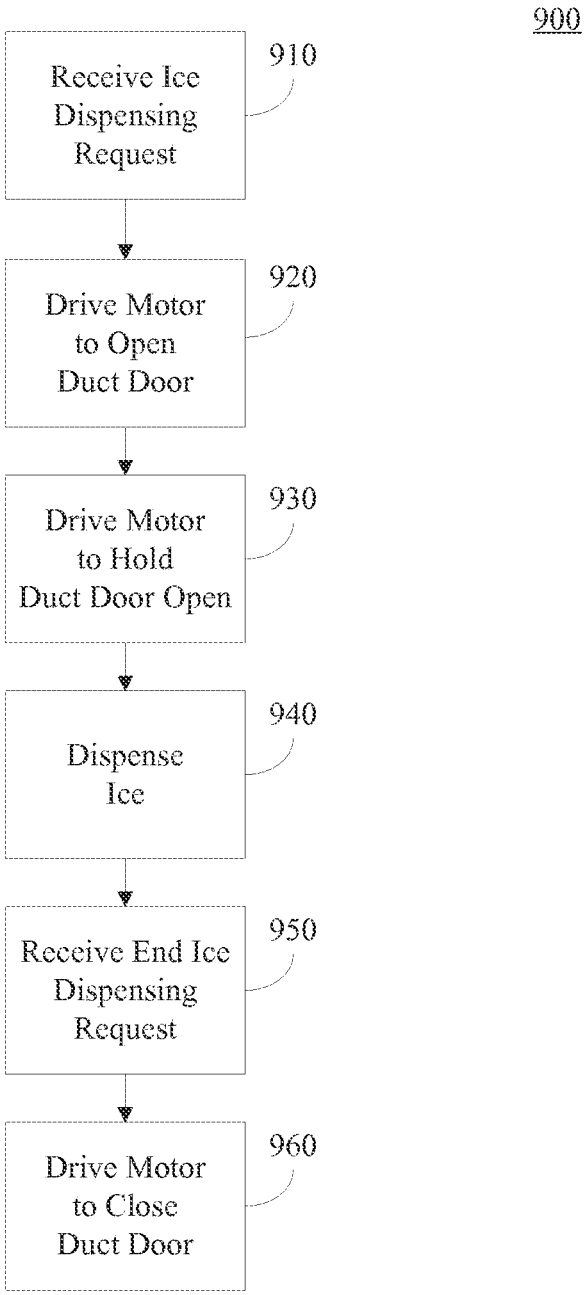
FIG. 10 depicts a flow chart of a method of controlling a duct door assembly according to an exemplary embodiment of the present disclosure.

FIG. 10 illustrates a flow chart of exemplary method 900 according to an exemplary embodiment of the present disclosure. The method 900 can be implemented with any suitable appliance having a duct door assembly in an ice dispensing system. In addition, although FIG. 10 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

An ice dispensing request can be received by the controller at (910). After receiving the request, the controller can send a signal to the duct door driving motor to open the duct door at (920). The controller can drive the motor using an electrical signal having an increasing slope to open the duct door. At (930), the controller can drive the motor to hold the duct door open and ice can be dispensed through the ice dispensing duct at (940). The signal to hold the duct door in the open position can be an electrical signal having a constant value such that the constant value is less than a peak value of the electrical signal having an increasing slope used to open the duct door. After the ice is dispensed, a signal can be received indicating a request of the end of ice dispensing at (950). An electrical signal having a decreasing slope can be applied to the motor such that the motor is driven to actuate the duct door into a closed position (960).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly in an appliance, comprising:

an icemaker assembly configured to form ice cubes and store ice cubes;

an ice cube duct configured to direct ice cubes from the icemaker assembly;

a duct door coupled to the ice cube duct, the duct door configured to actuate between an open position and a closed position where ice cubes are directed from the icemaker assembly when the duct door is in the open position;

a motor configured to actuate the duct door between the open position and the closed position; and a controller configured to adjustably drive the motor by performing operations, the operations comprising:

receiving a dispense signal indicating that a user has requested dispensing of ice;

when the dispense signal is received, ramping from zero to a first positive value the voltage of a direct current power signal applied to the motor, such that the torque applied to actuation of the duct door gradually increases in value;

holding the voltage of the direct current power signal at a second positive value, the second positive value being less than the first positive value;

ramping from the second positive value to a first negative value the voltage of the direct current power signal after the dispense signal is no longer received; and returning the voltage of the direct current power signal to zero after the first negative value is reached.

2. The ice dispensing assembly in an appliance as in claim 1, wherein the motor is electrically driven in a first direction when the voltage of the direct current power signal is positive in value and the motor is electrically driven in a second direction opposite the first direction when the voltage of the direct current power signal is negative in value.

3. The ice dispensing assembly in an appliance as in claim 1, further comprising a spring coupled to the duct door, the spring configured to bias the duct door towards the closed position.

4. The ice dispensing assembly in an appliance as in claim 1, further comprising a planetary gearbox coupled to the motor, where the planetary gearbox is configured to increase driving torque and reduce rotational speed of the motor.

5. The ice dispensing assembly in an appliance as in claim 1, further comprising a temperature sensor configured to detect a temperature in the icemaker assembly.

6. The ice dispensing assembly in an appliance as in claim 5, wherein an alert is initiated when an output of the temperature sensor is indicative of the duct door being fixed in the open position, and wherein the alert is provided to the user.

7. A method of controlling a motor coupled to a duct door of an ice dispensing assembly of an appliance, the method comprising:

receiving a dispense signal indicating that a user has requested dispensing of ice;

when the dispence signal is received, ramping from zero to a first positive value the voltage of a direct current power signal applied to the motor, such that the torque applied to actuation of the duct door from a closed position to an open position gradually increases in value;

holding the voltage of the direct current power signal at a second positive value;

ramping from the second positive value to a first negative value the voltage of the direct current power signal after the dispense signal is no longer received; and returning, the voltage of the direct current power signal to zero after the first negative value is reached.

8. The method of controlling an ice dispensing assembly of an appliance as in claim 7, wherein the second positive value is less than the first positive value.

9. The method of controlling an ice dispensing assembly of an appliance as in claim 7, wherein the motor is driven in a first direction when the voltage of the direct current power signal is positive and the motor is driven in a second direction opposite the first direction when the voltage of the direct current power signal is negative.

10. The method of controlling an ice dispensing assembly of an appliance as in claim 7, further comprising detecting a temperature in the icemaker assembly.

11. The method of controlling an ice dispensing assembly of an appliance as in claim 10, further comprising initiating an alert to the user when the temperature in the icemaker assembly exceeds a predetermined threshold.

12. An ice dispensing assembly in an appliance, comprising:

an ice maker assembly configured to form ice cubes and store ice cubes;

an ice cube duct configured to direct ice cubes from the icemaker assembly;

a duct door coupled to the ice cube duct, the duct door configured to actuate between an open position and a closed position where ice cubes are directed from the icemaker assembly when the duct door is in the open position;

a motor configured to actuate the duct door between the open position and the closed position; and a controller configured to adjustably drive the motor by performing operations, the operations comprising:

receiving a dispense signal indication that a user has requested dispensing of ice;

when the dispense signal is received, increasing from zero to a first positive value the voltage of a direct current power signal applied to the motor and holding the voltage of the direct current power signal at the first positive value for a first period of time;

after the first period of time, adjusting the voltage of the direct current power signal from the first positive value to a second positive value and holding the voltage of the direct current power signal at the second positive value for a second period of time;

reducing the voltage of the direct current power signal from the second positive value to a first negative value after the dispense signal is no longer received and holding the voltage of the direct current power signal at the first negative value for a third period of time; and returning the voltage of the direct current power signal to zero after the third period of time.

13. The ice dispensing assembly as in claim 12, wherein the controller adjustably drives the motor using pulse width modulation.

14. The ice dispensing assembly of claim 3, wherein;

applying the direct current power signal to the motor at the first positive value results in the motor providing sufficient torque to overcome the biasing force of the spring and actuate the duct door towards the open position; and holding the voltage of the direct current power signal at the second positive value results in the motor providing sufficient torque to offset the biasing force of the spring and hold the duct door in the open position.

15. The ice dispensing assembly of claim 1, wherein ramping from the second positive value to the first negative value the voltage of the direct current power signal after the dispense signal is no longer received comprises:

determining that the dispense signal is no longer being received;

holding the voltage of the direct current power signal at the second positive value for a predetermined delay period after it is determined that the dispense signal is no longer being received; and ramping from the second positive value to the first negative value the voltage of the direct current power signal after the predetermined delay period.

16. The ice dispensing assembly of claim 1, wherein receiving the dispense signal indicating that a user has requested dispensing of ice comprises receiving a paddle signal indicating that a paddle of the ice dispensing assembly has been pressed.

17. The ice dispensing assembly of claim 5, wherein the controller is configured to perfbrm further operations comprising:

receiving an output of the temperature sensor;

determining when the temperature in the icemaker assembly is greater than a threshold value based on the output; and when it is determined that the temperature in the icemaker assembly is greater than the threshold value, operating the motor to actuate the duct door towards the closed position.

18. The ice dispensing assembly of claim 17, wherein operating the motor to actuate the duct door towards the closed position comprises applying the direct current power signal to the motor at a second negative voltage value.

19. The method of claim 7, wherein ramping from the second positive value to the first negative value the voltage of the direct current power signal after the dispense signal is no longer received comprises:

determining that the dispense signal is no longer being received;

holding the voltage of the direct current power signal at the second positive value for a predetermined delay period after it is determined that the dispense signal is no longer being received; and ramping from the second positive value to the first negative value the voltage of the direct current power signal after the predetermined delay period.

20. The method of claim 7, wherein ramping from zero to a first positive value the voltage of the direct current power signal applied to the motor comprises ramping from zero to the first positive value the voltage of the direct current power signal over a time interval that is about one second in duration, such that the torque applied to actuation of the duct door from the closed position to the open position gradually increases in value over the time interval that is about one second in duration.

* * * * *

UNITED STATES PATENT AND TRADEMARK OFFICE

CERTIFICATE OF CORRECTION

PATENT NO. : 8,690,027 B2
APPLICATION NO. : 13/523004
DATED : April 8, 2014
INVENTOR(S) : Justin Daniel Berger and Andrew Reinhard Krause It is certified that error appears in the above-identified patent and that said Letters Patent is hereby corrected as shown below:

In the Claims

Column 10, Line 24, Claim 17, "...configured to perfbrm..." should read --...configured to perform...--.

Signed and Sealed this
Fourteenth Day of April, 2015

Michelle K. Lee

Michelle K. Lee
*Director of the United States Patent and Trademark Office*